US005407189A

United States Patent [19]

Klenk

[11] Patent Number: 5,407,189

[45] Date of Patent: Apr. 18, 1995

[54] APPARATUS FOR CONTINUOUS SHEET DELIVERY HAVING A SEPARATING BELT FOR SEPARATING A FILE OF SHEETS

[75] Inventor: Rainer Klenk, St. Leon-Rot, Germany

[73] Assignee: Heidelberger Druckmaschinen AG, Heidelberg, Germany

[21] Appl. No.: 69,633

[22] Filed: Jun. 1, 1993

[51] Int. Cl.[6] ..... B65H 31/12

[52] U.S. Cl. ..... 271/218; 414/790.8

[58] Field of Search ..... 271/218; 414/790.8

[56] References Cited

U.S. PATENT DOCUMENTS

| | | | |
|---|---|---|---|
| 3,972,524 | 8/1976 | Despot et al. | 271/218 |
| 4,359,218 | 11/1982 | Karis | 414/790.8 X |
| 4,796,879 | 1/1989 | Martini et al. | 271/218 |
| 4,799,847 | 1/1989 | Bodewein | 414/790.8 |
| 4,878,659 | 11/1989 | Besemann | 271/218 |
| 5,145,159 | 9/1992 | Vits | 270/52 |

FOREIGN PATENT DOCUMENTS

| | | | |
|---|---|---|---|
| 0476264A1 | 3/1992 | European Pat. Off. | B65H 31/32 |
| 3535113A1 | 4/1987 | Germany | B65H 31/32 |
| 4021676C1 | 11/1991 | Germany | B65H 3/32 |
| 4029919C1 | 4/1992 | Germany | B65H 31/32 |
| 40188 | 3/1980 | Japan | 271/218 |
| 7509635 | 11/1976 | Netherlands | 271/218 |

OTHER PUBLICATIONS

Oxy-Dry Pamphlet.

*Primary Examiner*—Robert P. Olszewski
*Assistant Examiner*—Boris Milef
*Attorney, Agent, or Firm*—Kenyon & Kenyon

[57] ABSTRACT

The invention provides a method and apparatus for continuous sheet delivery. According to the invention, a continuous stream of sheets is separated into a main pile, supported by a removable pallet, and an auxiliary pile, in which sheets are stored while the pallet and the main pile are removed and a new pallet is introduced. An embodiment of the invention includes a sheet supply, a pallet for accepting sheets from the sheet supply to form a main pile, a belt having a widened portion forming an edge for separating the edges of the pile to define an auxiliary pile, an auxiliary pile support, and a main pile. The auxiliary pile is divided from the main pile and supported separately therefrom by the dividing means while the pallet is replaced.

12 Claims, 6 Drawing Sheets

29
30
30a
30b
19
20
2
20a
28
21b
7
7a
7c
7d
21
6
21b
18
16
2c
11
17
15
10a
14
10b
13
12b
8b

APPARATUS FOR CONTINUOUS SHEET DELIVERY HAVING A SEPARATING BELT FOR SEPARATING A FILE OF SHEETS

FIELD OF THE INVENTION

The invention relates to an apparatus and method for the continuous delivery of printed sheets, particularly of sheets that have been cut off from a web of material on rotary printing presses.

BACKGROUND OF THE INVENTION

DE 40 21 676 C1 discloses a device for changing a pile in a sheet delivery device. A first slide, moving laterally into the pile region, lifts a corner of a pile with blow-air support and enters completely into the pile region until a second, flat slide enters into the pile region perpendicularly to the direction of motion of the first slide and in the opposite direction to the conveying direction of the sheets. Since the pile must be able to be laid open for transport, the second slide, which is held by an angled carrying arm, is adapted to be swung away about a column. The result of this arrangement is that the sheet delivery is longer in length and takes up space both when the second slide is swung away and also when it is in engagement.

In a brochure from Oxy-Dry, which is accessible to the relevant experts, there is an illustration of, among other things, a flat sheet delivery in which one of the design details is a rake with a plurality of prongs, the rake being movable into the pile region from the front side of the pile. It is left to the printer to determine the correct time for the removal of the rake when there is a change of pile. It is not possible with this design to obtain a defined pile separation and, moreover, automation of the process is very difficult.

OBJECTS AND SUMMARY OF THE INVENTION

An object of the invention is to provide an apparatus and method for continuous sheet delivery that allows for a maximum production speed.

A further object is to provide an apparatus and method for continuous sheet delivery that can be fully automatic.

Another object of the invention is to guarantee operationally reliable pile separation.

The object of the invention is achieved in that a lowerable auxiliary-pile unit comprises both remotely controlled, flexible means, revolvable perpendicularly to the transport direction of sheets, and also remotely controlled, horizontally insertable and retractable dividing means for the defined separation of a continuous stream of sheets into a main pile and an auxiliary pile.

The apparatus for continuous sheet delivery therefore comprises a sheet supply; a pallet for accepting sheets from the sheet supply so that the sheets form a pile on the pallet; flexible means for separating the edges of the pile to define an auxiliary pile and a main pile; and means for dividing the auxiliary pile from the main pile, so that when the auxiliary pile is divided from the main pile, the dividing means supports the auxiliary pile and the pallet supports the main pile. The flexible means may comprise a separating belt having a widened portion defining a separating edge that can be selectively inserted into and removed from the pile.

An advantage of this design is that the invention allows a clearly defined separation of a continuous stream of sheets at maximum production speeds.

A further advantage of this invention is that separation into a main pile and an auxiliary pile can take place automatically, without there being any need for operating personnel to intervene, and therefore allowing the invention to be optimally integrated into an automation concept.

Another advantage of the invention is that a high production output of an upstream processing machine can be maintained.

A still further advantage of the invention is that, after the product stream has been separated into the main pile and the auxiliary pile, each pile is treated separately, without there being any disadvantageous cross-influencing.

The invention also provides that the lowerable auxiliary-pile unit is disposed on the same side of the delivered sheets as the sheet supply. This means that the auxiliary-pile unit can be integrated advantageously into the overall design of a cross-cutter so that little space is taken up. The piles to be transported away are easily accessible from all sides. Furthermore, it is provided that, when the main pile is changed, the lowerable auxiliary-pile unit is lowered in proportion to the production speed. Consequently, the non-stop apparatus can be employed during pile changing in such a manner that a free space is always guaranteed above the auxiliary pile to allow for the depositing of the conveyed sheets.

In an advantageous embodiment, the flexible means is in the form of a separating belt with a separating edge. This permits a compact, space-saving design below the sheet supply. Furthermore, the separating edge of the separating belt is adapted to be moved, via guide rollers, into the pile region perpendicularly to the transport direction of the sheets. This makes it possible to achieve early separation of the pile irrespective of the pile height or of the product thickness being processed. The invention also advantageously provides that horizontally insertable and retractable dividing means are in the form of an auxiliary-pile support with spherical nozzles disposed on the pile surface. This allows the auxiliary-pile table to be moved in and out more or less without friction through the building-up of an air cushion irrespective of the auxiliary-pile height. Easy mobility of the auxiliary-pile support is achievable in that the auxiliary-pile support is adapted to be moved in guides, the guides holding roller pins. This allows the auxiliary-pile support to be guided precisely with zero play and also without tilting when under load. Furthermore, the auxiliary-pile support comprises a bevelled part as well as blow-air openings at its end facing the continuous stream of sheets. This prevents damage to the edges of the bottom-most sheets when the auxiliary-pile support is inserted into the pile region. Finally, it should be mentioned that the auxiliary-pile support is adapted to be moved, by remotely controlled, pressure-energized drives, parallel to the conveying direction of the sheets. Furthermore, a carrying frame of the lowerable auxiliary-pile unit, the carrying frame being connected to auxiliary-pile guides, is of such design that it is adapted to be moved vertically via a chain anchor, chains and a production-speed-controlled lifting drive.

The present invention also provides a method for continuous sheet delivery comprising the steps of: (a) delivering sheets onto a pallet so as to form a pile; (b) separating the edges of the pile with a separating belt to define an auxiliary pile and a main pile; and (c) inserting an auxiliary pile support under the auxiliary pile, so that auxiliary pile is supported by the auxiliary pile support and the main pile is supported by the pallet, as well as the steps of (d) moving the pallet away from the auxiliary pile; (e) placing an empty pallet under the auxiliary pile support; (f) raising the empty pallet until is just below the auxiliary pile support; and (g) retracting the auxiliary pile support to allow the auxiliary pile to be supported by the empty pallet.

BRIEF DESCRIPTION OF THE DRAWINGS

In the following, a preferred embodiment of the invention is described in greater detail with reference to the drawings, in which.

DETAILED DESCRIPTION OF THE DRAWINGS

Figure 1A:
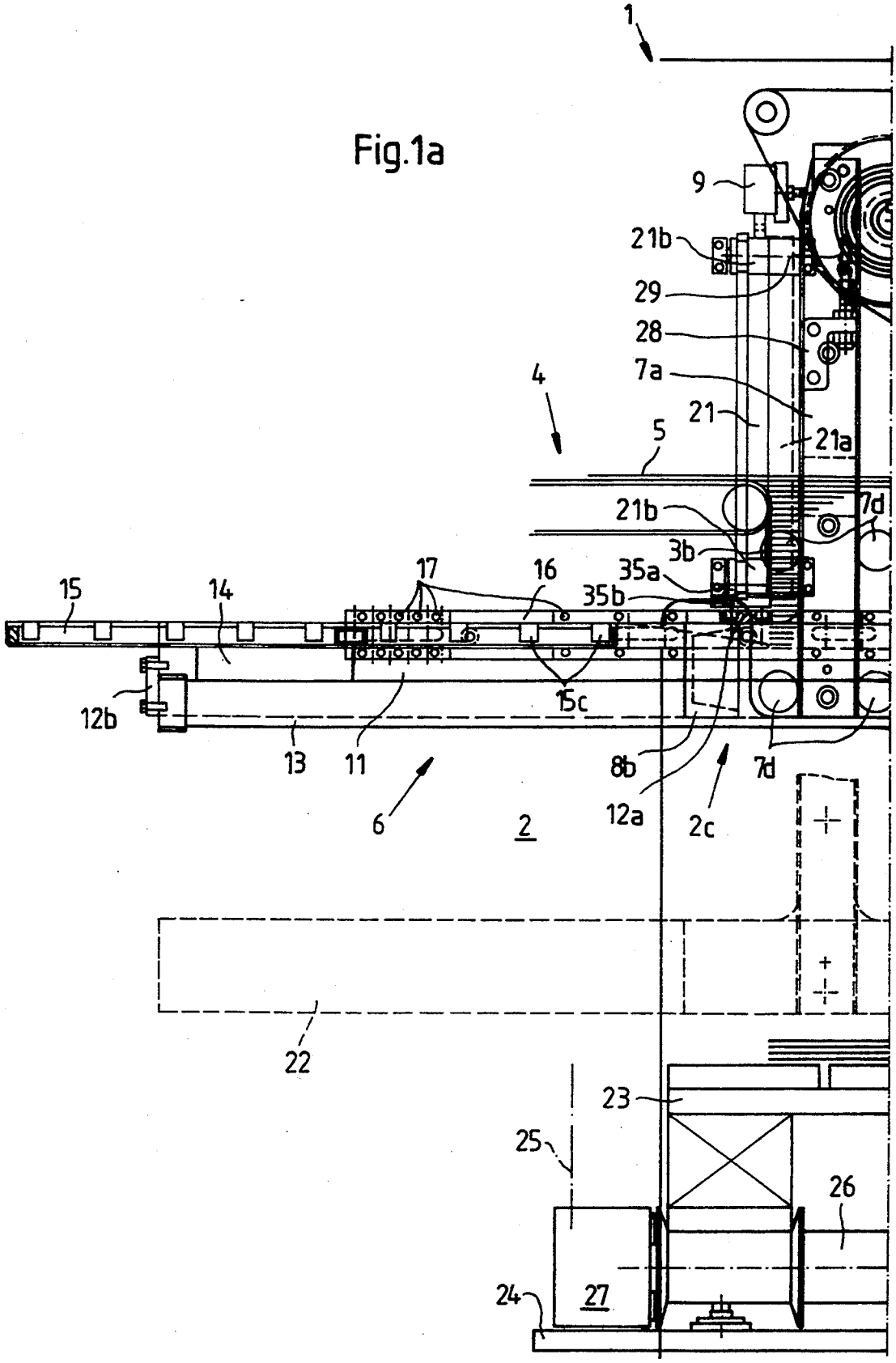
FIG. 1*a* shows the part of the apparatus for continuous sheet delivery situated to the left of a vertically extending separating line.
Figure 1B:
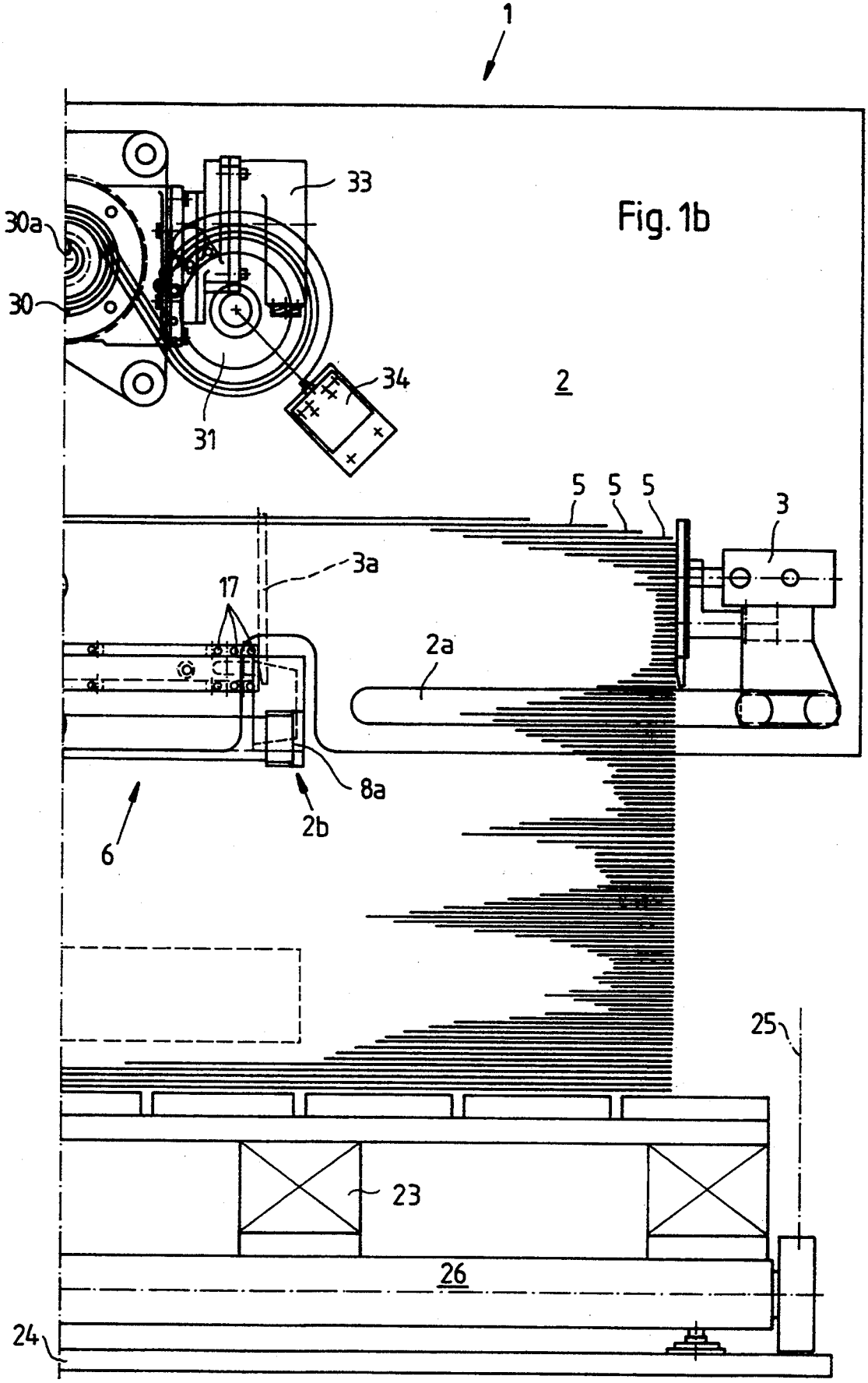
FIG. 1*b* shows the parts of the apparatus for continuous sheet delivery situated to the right of the above-mentioned separating line.

FIG. 1*a* shows the left-hand half of a sheet-delivery device 1, the device being shown in two parts for reasons of space. FIG. 1*b* shows the right-hand half of the sheet-delivery device 1, the right-hand half adjoining the vertically extending separating line. The lateral boundary of the sheet-delivery device 1 is formed by side walls 2, which have a cutout 2*a* in which an adjustable stop 3 can be displaced. Further held in the stop 3 is a vibrating device, which correctly aligns the sheets 5 against a front stop 3*b*. The sheets 5 are conveyed into the pile region from the sheet supply 4. In the pile region, 3*a* identifies a position that is assumed by the adjustable stop 3 whenever production is being carried out in half-copy-length mode. Furthermore, the side walls 2 comprise two cutouts 2*b* and 2*c*, in which sections 8*a* and 8*b*, respectively, are accommodated when an auxiliary-pile unit 6 is in a raised position. A carrying frame 11 is connected by bolted connections to the sections 8*a* and 8*b*. Through the intermediary of the sections 8*a*, 8*b*, the carrying frame 11 is attached to an auxiliary-pile guide 7, which has a guide section 7*a*. When the auxiliary-pile unit 6 is lifted vertically, the guide section 7*a* runs in guide rollers 7*d* accommodated by the side wall 2. Provided at the upper end of the guide section 7*a* is a lifting limit switch 9, which, when a defined lifting height is attained, prevents the further raising of the auxiliary-pile unit 6.

A horizontally displaceable auxiliary-pile support 15 is held on the vertically movable carrying frame 11. Spherical nozzles 15*c* are provided on the surface of the auxiliary-pile support 15 (see also FIG. 4). The auxiliary-pile support 15 is held on both sides in guide sections 16. The guide section 16, which, in the described embodiment, is U-shaped, is provided with horizontally held roller pins 17, which are disposed on both legs of the guide section 16. This makes it possible to guarantee the freedom of movement of the auxiliary-pile support 15, even when under load. In order to prevent the auxiliary-pile support 15 from tilting, a plurality of roller pins 18 are disposed vertically in the guide sections 16. Linear drives 13 are installed longitudinally at the sides on the carrying frame 11, which consists of two longitudinal sections and of a rear cross-member 12*b* and a central cross-member 12*a*. The pressure-energizable linear drives 13 guide a driver 14, which, in turn, is connected to the underside of the auxiliary-pile support 15. When the linear drives 13 are pressure-energized under remote control, the auxiliary-pile support 15 moves in the horizontal direction in the guide sections 16. Instead of the linear drives 13 shown in the specimen embodiment, it would also be conceivable to drive the auxiliary-pile support 15 through the intermediary of positive non-slip driving elements such as a toothed-belt drive.

Indicated below the auxiliary-pile unit 6 by a broken-line position 22 is the auxiliary-pile unit 6 in a lowered position, which the auxiliary-pile unit 6 assumes during the changing of the main pile while production at an upstream rotary printing press is in progress. The main pile rests on a pallet 23, which is held by guide rollers 26 provided on the main-pile plate 24. The main-pile plate 24 is moved vertically up and down by conveying chains 25. The conveying chains 25 allow the movements of main-pile plate 24 and auxiliary-pile unit 6 to be decoupled. Via pallet-conveying apparatus 27, the pallet 23 is transported away while the main-pile plate 24 is in the lowered state and a new empty pallet 23 is positioned onto the main-pile plate 24. The main-pile plate 24 is then moved back underneath the auxiliary-pile unit 6 (see FIG. 5).

Visible above the auxiliary-pile unit 6 is the vertically extending guide section 7*a*, to which a chain anchor 28 is attached. Attached to the chain anchor 28 is a chain 29, which passes around a chain wheel 30. The chain wheel 30 is non-rotatably seated on a chain-wheel shaft 30*a*. Disposed to the right of the chain wheel 30 is a chain store 31, which, supported by a return spring 32 (not shown here), permits the upward movement of the auxiliary-pile unit 6. The chain wheel 30 is associated with a lifting drive 33 as well as a limit switch 34. Situated below the sheet supply 4, but above the guide section 16, is the separating belt guide 35*a*, 35*b*, which is of two-part design and holds the revolvable separating belt 21. The broken line identified by 21*a* is intended to indicate the extent of the separating belt 21 including the separating belt edge 21*a* when said separating belt 21 is not inserted between individual sheets 5 across the entire pile width. Identified by 21*b* are the guide rollers for the separating belt 21, which are attached to the inside of the side wall 2 in the region of the sheet supply 4 (see also FIG. 2).

Figure 2:
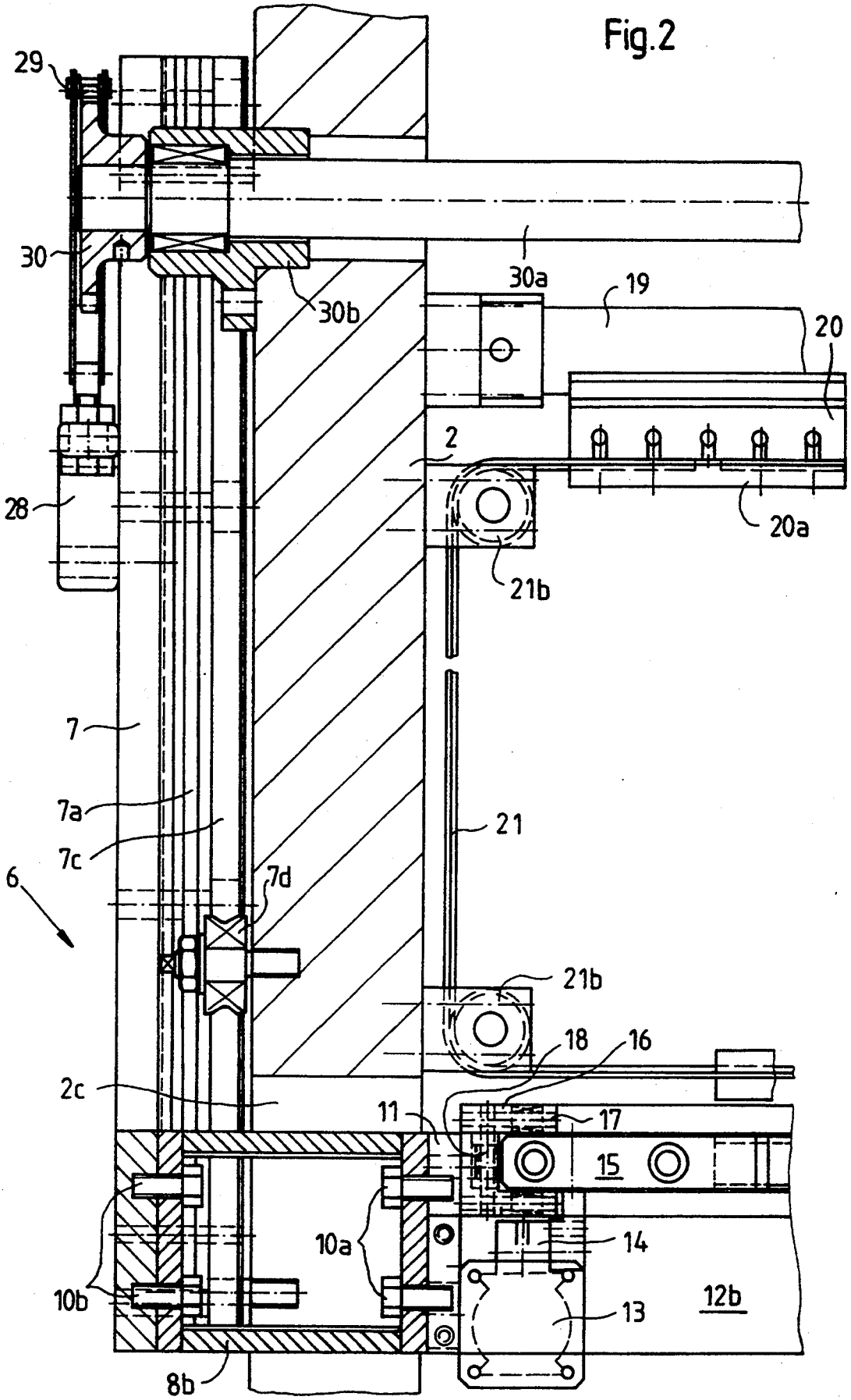
FIG. 2 shows a cross section through the side wall 2 and the carrying frame 11.

FIG. 2 shows a cross section through a side wall 2 as well as through the carrying frame 11. The auxiliary-pile guide 7 is disposed to the left of the side wall 2, which accommodates the chain-wheel bearing bushing 30*b*, in which the chain-wheel shaft 30*a* is rotatably held. Seated at the outer end of the chain-wheel shaft 30*a* is the chain wheel 30 over which the chain 29 runs. The chain 29 is connected to the chain anchor 28, which, in turn, is attached to the auxiliary-pile guide 7. The auxiliary-pile guide 7 is held together by bolts (shown by broken lines) and comprises a centrally disposed guide section 7*a*, into which are recessed round bars 7c. Provided in the side wall 2 are a plurality of guide rollers 7d, in which the auxiliary-pile guide 7 is guided in a low-friction manner during its vertical movements. The cutout 2c is situated in the lower region of the side wall 2 (shown in cutaway form). Inserted into the cutout 2c is the assembly consisting of the auxiliary-pile guide 7, the section 8b and the flanged-on carrying frame 11. The auxiliary-pile guide 7 is connected to the carrying frame 11 by the bolted connections 10b and 10a and the sections 8a and 8b. The guide sections 16, which are bolted to the carrying frame 11 and which are, in this case, U-shaped, accommodate roller pins 17, 18, which are disposed horizontally or vertically. The auxiliary-pile support 15 moves on the roller pins 17, 18. Indicated in cross section below the auxiliary-pile support 15 is the linear drive 13, which is connected through the intermediary of a driver 14 to the underside of the auxiliary-pile support 15. The separating belt 21 is disposed above the auxiliary-pile support 15. The separating belt 21 runs over guide rollers 21b, which are attached to the side wall 2. Disposed next to the chain-wheel shaft 30a is a linear drive 19, which extends between the side walls 2 and which is connected through the intermediary of a driver 20 to the separating belt 21. For reasons of clarity, the remotely controlled linear drive 19 is shown here below the chain-wheel shaft 30a. Also clamped together at the driver 20 by means of a clamping plate 20a are the two end-pieces of the separating belt 21. When the linear drive 19 is energized with pressure, the widened section of the separating belt 21, the separating belt edge 21a, is moved—depending on the position of the separating belt 21—either out of or into the pile region of the sheets 5.

In addition to such revolvable guiding of the separating belt 21, it would also be conceivable to install a take-up reel for the separating belt 21 on each of the side walls 2. The take-up reels, provided with a reversible electric drive, could then guide the widened separating belt edges alternately into and out of the pile region.

Figure 3:
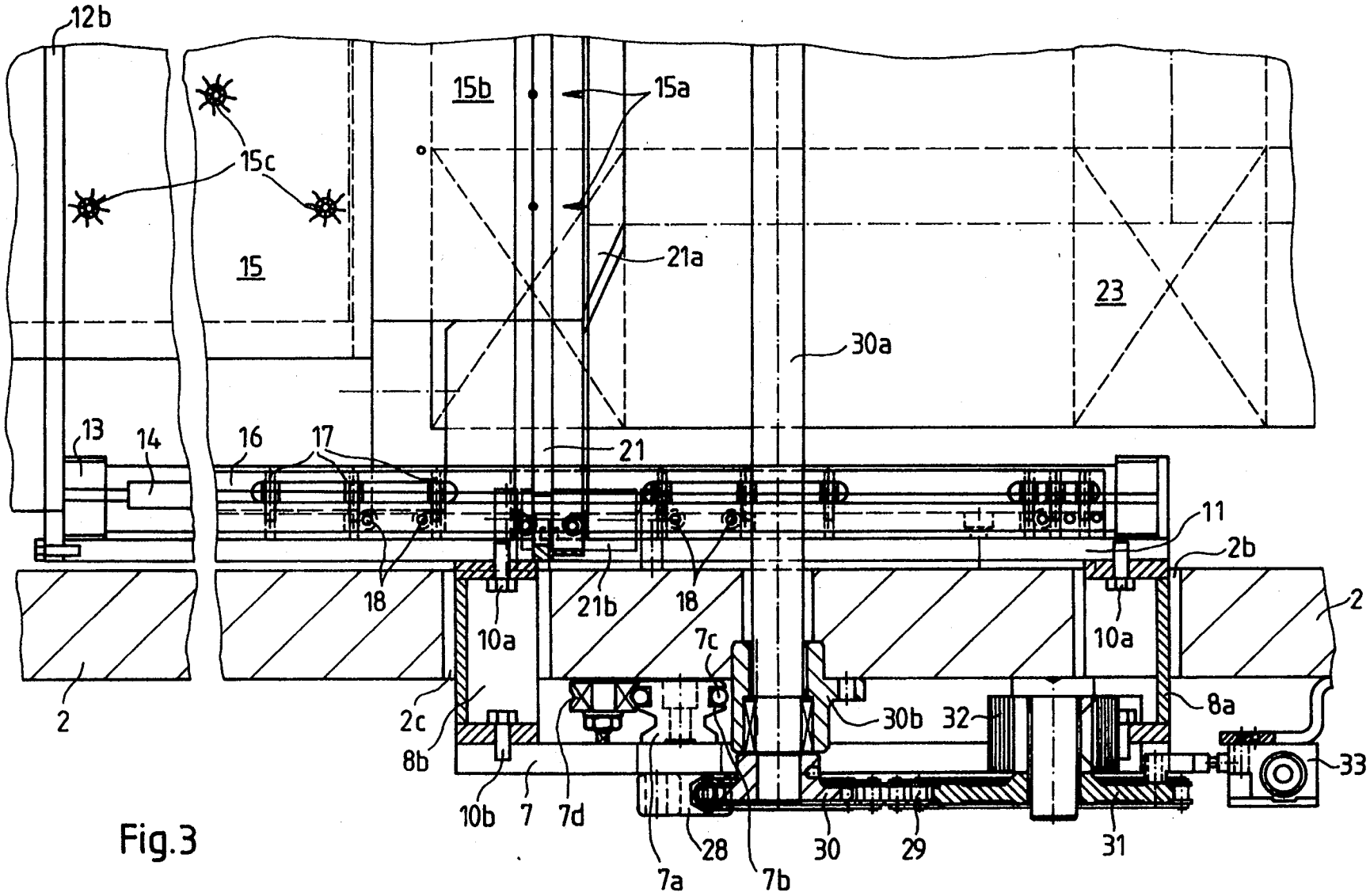
FIG. 3 shows a partially cut-away top view in the region of the side wall 2.

FIG. 3 shows a partially cut-away top view of the sheet delivery device 1. Visible in the cutouts 2b and 2c of the side wall 2 are the sections 8a and 8b, to which the carrying frame 11 is attached by means of the bolted connections 10a. Bolted to the carrying frame 11 is the guide section 16, recessed into which for the positionally accurate and low friction guiding of the auxiliary-pile support 15 are both horizontally held roller pins 17 and also vertically disposed roller pins 18. Extending parallel to the carrying frame 11 is the remotely controlled linear drive 13, in which the driver 14 is displaceably guided. By means of the cross-member 12b, the carrying frame 11 is connected at its rear end to its counterpart on the opposite side. Visible above the carrying frame 11 is the horizontally displaceable auxiliary-pile support 15, on which spherical nozzles 15c are provided. In its front region, the auxiliary-pile support 15 comprises a bevelled part 15b, in which blow-air openings 15a are provided at regular intervals.

The separating belt 21 extends across the front edge of the auxiliary-pile support 15. The separating belt 21 has two width zones. In the zone that here runs over the guide roller 21b, the separating belt 21 is of single width; in the region of the separating belt edge 21a, it is almost of double width. The double-width section of the separating belt is of such dimensions that, when in the position in which it is inserted into the pile region, it extends across the entire breadth of the pile.

Shown below the auxiliary-pile support 15 is the pallet 23, with the chain-wheel shaft 30a being shown above the pallet 23. The chain-wheel shaft 30a is held by the bushing 30b in the side wall 2 and carries the chain wheel 30, over which runs the chain 29, coming from the chain store 31 with return spring 32. Held in the lower region of the side wall 2 are guide rollers 7d, in which the guide sections 7a roll. Recessed into the grooves 7b of the guide section 7a are round bars 7c, which considerably reduce the friction during vertical movement.

Figure 4:
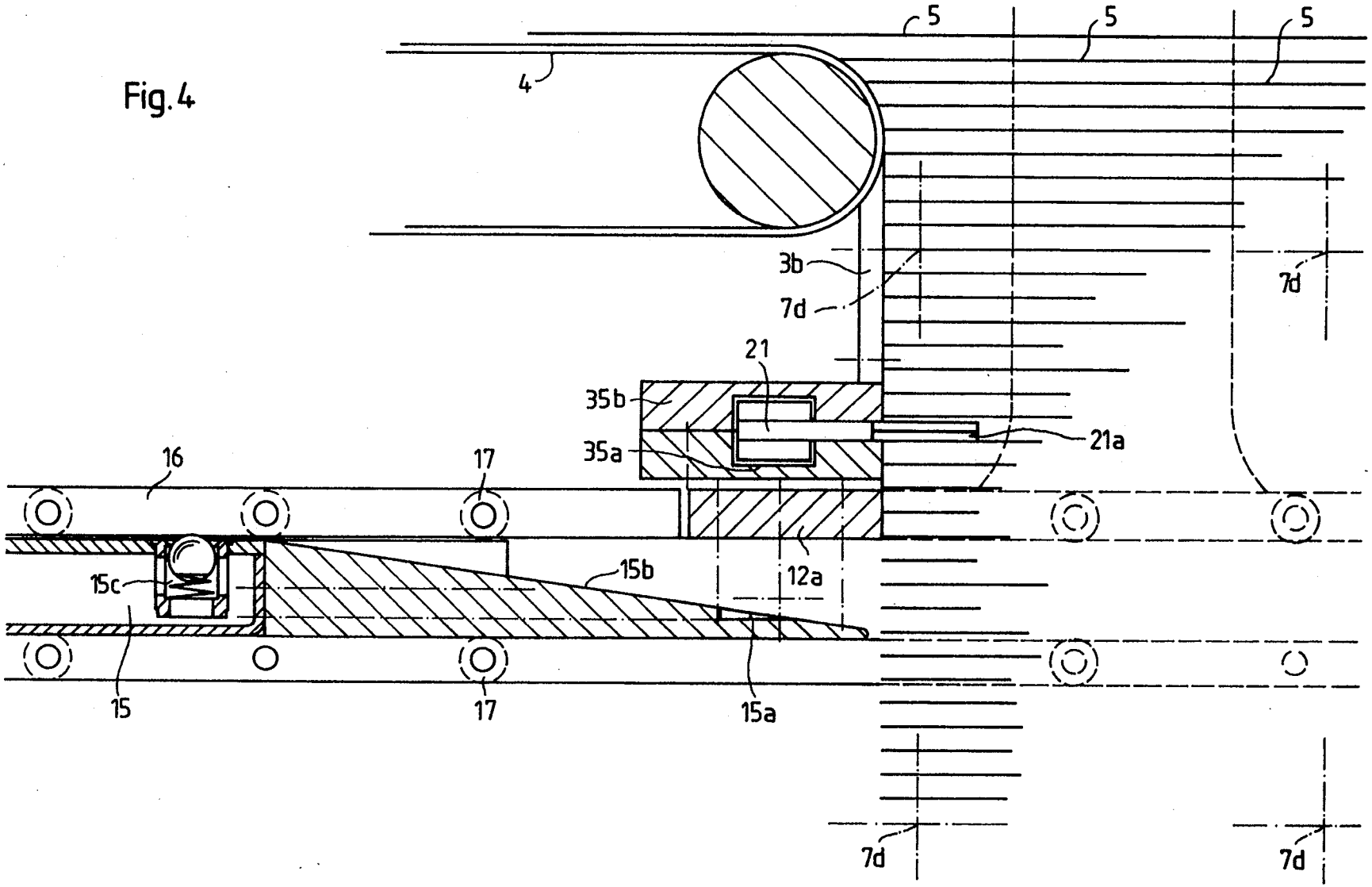
FIG. 4 shows an enlarged representation of the separating belt periphery.

Finally, FIG. 4 shows an enlarged representation of the separating belt periphery. The separating belt 21 is held by a two-part separating belt guide 35a, 35b. The separating belt 21 is guided at the side walls 2 by guide rollers. It can be seen here that the widened region of the separating belt 21, namely the separating belt edge 21a, projects into the pile region of the sheets 5. Disposed below the two-part separating belt guide 35a, 35b is a central cross-member 12a, which extends parallel to the rear cross-member 12b and which stiffens the carrying frame 11. Accommodated near to the central cross-member 12a is the guide section 16, in which the auxiliary-pile support 15 is movable in the horizontal direction. Recessed into said guide section 16 are horizontally held roller pins 17, which guide the auxiliary-pile support 15. In addition to spring-loaded spherical nozzles 15c on the surface, the auxiliary-pile support 15 has a bevelled part 15b. Provided in the bevelled part 15b and represented here by dash-dotted lines is a system of channels that supplies blow-air to blow-air openings 15a in order to build up a load-carrying air cushion. The blow-air openings 15a and the spherical nozzles 15c make it possible to achieve the virtually friction-free gliding of a paper pile on the auxiliary-pile support 15. The volume of blow-air can, of course, be adapted to the weight of the paper and to the height of the pile. The outlet of blow-air at the front edge can, moreover, prevent damage to the front edge of the lower most sheet 5 under which the auxiliary-pile support 15 is inserted. FIG. 4 once again schematically indicates the points at which the guide rollers 7d are held in the side walls 2.

The pile-changing operation that takes place during the time spans variously indicated in the following is fully automatic, without there being any need for intervention on the part of the machine-operating personnel.

Figure 5:
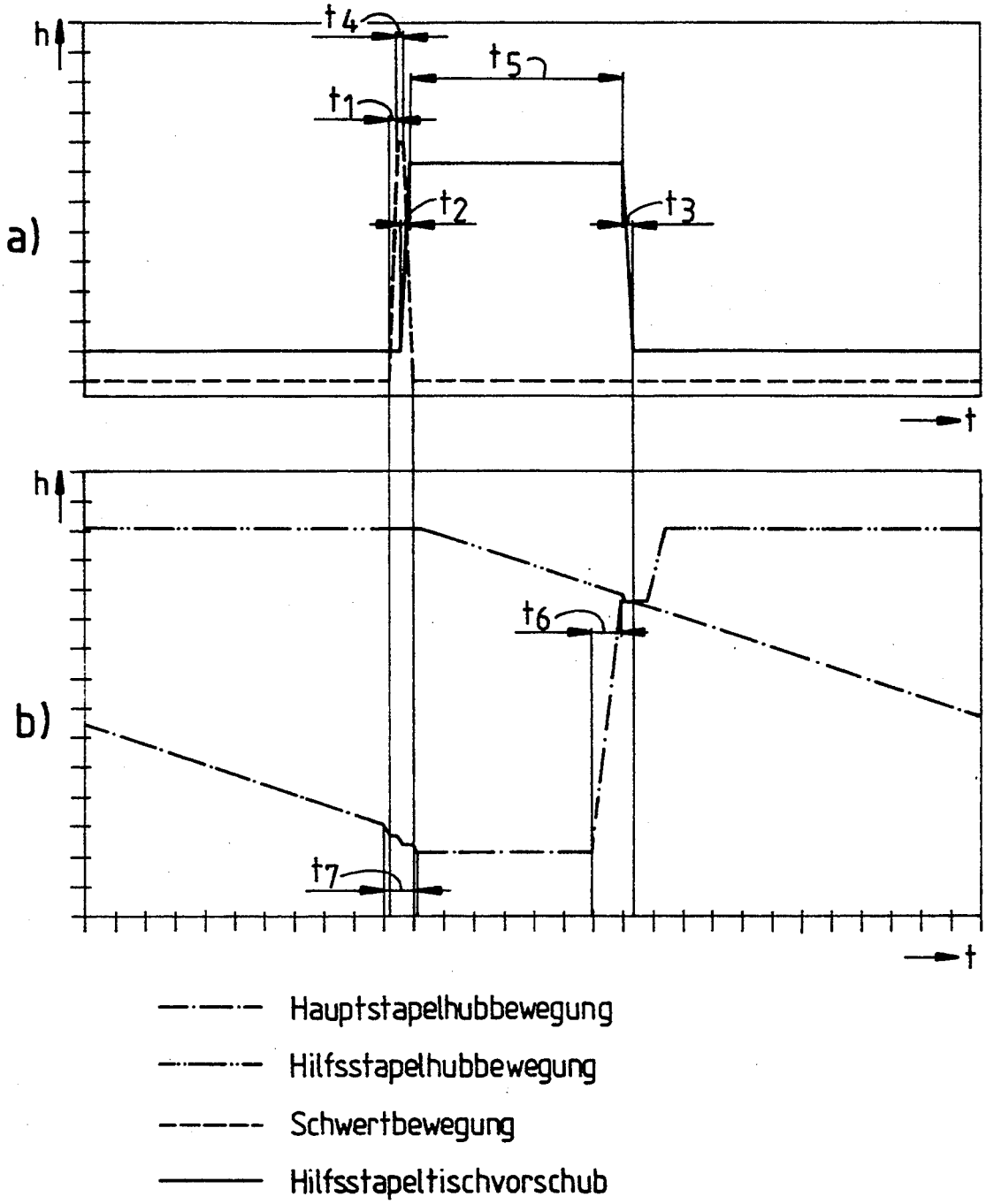
FIG. 5 shows a path/time diagram of main- and auxiliary-pile movements as well as of the separating belt and auxiliary-pile support movements.

With regard to the operating principle of said sheet delivery device, reference is made to the path/time diagram shown in FIG. 5. The main pile is continuously lowered in the course of continuous production. In FIG. 5b, this is indicated by a negatively sloping straight line (dash-dotted line). The auxiliary-pile support 15 remains in its basic position. The height of the pile may be detected by a sensor.

During time span $t_7$, the main-pile plate 24 is lowered in several stages. Through a first lowering stage of the main-pile plate 24, a buffer for accepting the continuous stream of sheets 5 is formed downstream of the sheet supply 4. Following the completion of the first lowering stage of the main-pile plate 24 during time $t_7$, the separating belt 21 is inserted, at the beginning of time span $t_1$), into the pile region perpendicularly to the production direction. At the end of time span $t_1$, the separating belt 21 has been inserted into the pile region, where it remains during time span $t_4$.

While the separating belt 21, inserted with its widened region 21a into the pile region, now acts to hold the rear edges of the sheets 5, the main-pile plate 24 is lowered by a further lowering stage in order to produce a space below the separating belt 21 into which the auxiliary-pile support 15, held in the guide sections 16, is able to extend. The extending of the auxiliary-pile support 15 takes place at the beginning of time span $t_2$. When the auxiliary-pile support 15 has extended by approximately $\frac{2}{3}$ (end of time span $t_4$), the separating belt 21 is removed from the pile region; the sheets 5 then continue to be piled on the auxiliary-pile support 15 (start of time span $t_5$).

After the separating belt 21 has returned to its original position, the main-pile plate 24 is lowered by a last lowering stage during time span $t_7$, with the result that the pallets can now be exchanged on the pallet-changing level.

In the meantime, the auxiliary-pile support 15 accepts the produced sheets 5 and continues to be lowered in proportion to the production speed. At the start of time span $t_6$, an empty pallet is rapidly lifted under the auxiliary-pile support 15 such that the latter is still able to be lowered in order to create a buffer for accepting sheets 5. After the auxiliary-pile support 15 has been lowered onto the empty pallet that has been brought up from below, the auxiliary-pile support 15 returns to its starting position (end of time span $t_5$ to end of time span $t_3$). The auxiliary pile on the auxiliary-pile support 15 is deposited onto the empty pallet. The conveying of the auxiliary pile is facilitated by an air cushion that has been built up by the spherical nozzles 15*c* between the auxiliary-pile support 15 and the lower most sheet 5 in the auxiliary pile. At the end of time span $t_3$, the auxiliary-pile support 15 is again completely held by the guide sections 16. Thereafter, the sheets 5 are accepted by the empty pallet which is held by the main-pile plate 24. Finally, the auxiliary-pile unit 6 moves up again into its starting position.

It should be understood that the concept of the invention herein described could encompass other embodiments, including other types of flexible separating means that also allow for the saving of space and ease of access to the pile of sheets.

What is claimed is:

1. An apparatus for continuous sheet delivery comprising:

a sheet supply;

a pallet for accepting sheets from the sheet supply so that the sheets form a pile on the pallet;

a separating belt having a widened portion defining a separating edge, the separating belt for separating the edges of the pile to define an auxiliary pile and a main pile; and means for dividing the auxiliary pile from the main pile, so that when the auxiliary pile is divided from the main pile, the dividing means supports the auxiliary pile and the pallet supports the main pile.

2. The apparatus as recited in claim 1, wherein the dividing means is disposed on the same side of the pile of sheets as the sheet supply.

3. The apparatus as recited in claim 1, further comprising means for lowering the dividing means in proportion to the production speed when the auxiliary pile is divided from the main pile.

4. The apparatus as recited in claim 1, further comprising means for selectively inserting the separating edge into and out of the pile.

5. The apparatus as recited in claim 4, wherein the means for selectively inserting the separating edge comprises a linear drive.

6. The apparatus as recited in claim 1, wherein the separating edge of the separating belt moves into the pile region perpendicularly to the transport direction of the sheet supply.

7. The apparatus as recited in claim 1, wherein the dividing means comprises an auxiliary-pile support.

8. The apparatus as recited in claim 7, wherein the auxiliary-pile support has air nozzles.

9. The apparatus as recited in claim 7, further comprising guide sections with roller pins for supporting the auxiliary-pile support.

10. The apparatus as recited in claim 7 wherein the auxiliary-pile support has a bevelled part on an end facing the pile.

11. The apparatus as recited in claim 7, further comprising a linear drive for moving the auxiliary-pile support.

12. The apparatus recited in claim 7, wherein the dividing means further comprises a carrying frame, a chain anchor, a chain, and a production-speed-controlled lifting drive.

* * * * *

UNITED STATES PATENT AND TRADEMARK OFFICE

CERTIFICATE OF CORRECTION

PATENT NO. : 5,407,189
DATED : April 18, 1995
INVENTOR(S) : R. Klenk et al.

It is certified that error appears in the above-indentified patent and that said Letters Patent is hereby corrected as shown below:

On the title page, left column, after "[22] Filed: Jun. 1, 1993", add:

--[30] Foreign Application Priority Data
May 29, 1992 Germany....P4217816.9--

Signed and Sealed this

Seventeenth Day of October, 1995

Bruce Lehman

*Attest:*

BRUCE LEHMAN

*Attesting Officer*

*Commissioner of Patents and Trademarks*